United States Patent [19]

Ruud

[11] 4,401,275

[45] Aug. 30, 1983

[54] ARRANGEMENT IN CONNECTION WITH NOZZLES OF POWDER SPRAYERS OR FOR DISINTEGRATION AND DISTRIBUTION OF SOLID PARTICLES IN POWDER FORM IN A GAS STREAM

[76] Inventor: Jan T. Ruud, Fregattgränd 1, S. 440 74 Hjälteby, Sweden

[21] Appl. No.: 221,444

[22] Filed: Dec. 30, 1980

[30] Foreign Application Priority Data

Jan. 4, 1980 [SE] Sweden ..... 8000066
May 20, 1980 [SE] Sweden ..... 8003751

[51] Int. Cl.[3] ..... B05B 5/02
[52] U.S. Cl. ..... 239/704; 239/143
[58] Field of Search ..... 239/143, 432, 590, 690, 239/704, 145

[56] References Cited

U.S. PATENT DOCUMENTS 3,873,024 3/1975 Probst et al. ..... 239/704
4,192,460 3/1980 Matsuo ..... 239/85 X
4,247,043 1/1981 Roeder et al. ..... 239/143 X

*Primary Examiner*—John J. Love
*Assistant Examiner*—Gene A. Church

[57] ABSTRACT

The invention relates to a device for a nozzle of a powder sprayer, which by way of example can be used for spraying for example color powder, which is electrostatically charged, or for disintegration and distribution of solid particles in powder form transported in a gas stream. By means of the present device, which is easy to operate and easy to connect with a transportation circuit respectively, the particle material is effectively disintegrated and distributed. The device has means (17; 51, 58, 75, 76) for the introduction of a gas stream under pressure in the stream of particles flowing through the device, whereby the powder during its forward transportation through the device under simultaneous compression is mixed with the gas rushing in.

8 Claims, 6 Drawing Figures

ARRANGEMENT IN CONNECTION WITH NOZZLES OF POWDER SPRAYERS OR FOR DISINTEGRATION AND DISTRIBUTION OF SOLID PARTICLES IN POWDER FORM IN A GAS STREAM

The present invention relates to an arrangement in connection with a nozzle of a powder sprayer, which for example can be utilized for the spray of colour in powder form, which is electrostatically charged, or for the disintegration and distribution of solid particles in powder form transported in a gas stream.

It is a principal object of the invention to provide an arrangement of the kind mentioned above, by means of which one can obtain a uniform and fine distribution and spread of the powder emerging from a spray nozzle, and which makes it possible to disintegrate and distribute the powder transported in a gas stream. A cone-shaped means placed in the orifice of the nozzle in order to bring about the spread of the powder has among other things been used in the prior art in connection with spray nozzles. However, a shadow has been formed behind this cone-shaped means, and objects placed behind the same have not been reached by the flow of powder in a satisfactory manner. Means used in the prior art for the disintegration and distribution of for example powder agglomerations collecting at tube bends in a gas stream between for example a powder hopper and a spray nozzle have not been of a simple design or easy to connect in a transportation circuit.

However, said object is reached by means of an arrangement according to the present invention, which is substantially characterized by means for the introduction of a gas stream at a pressure in the flow of particles passing through the device, whereby the powder during its forward transportation through the device under simultaneous compression is mixed with the gas rushing in.

Figure 1:
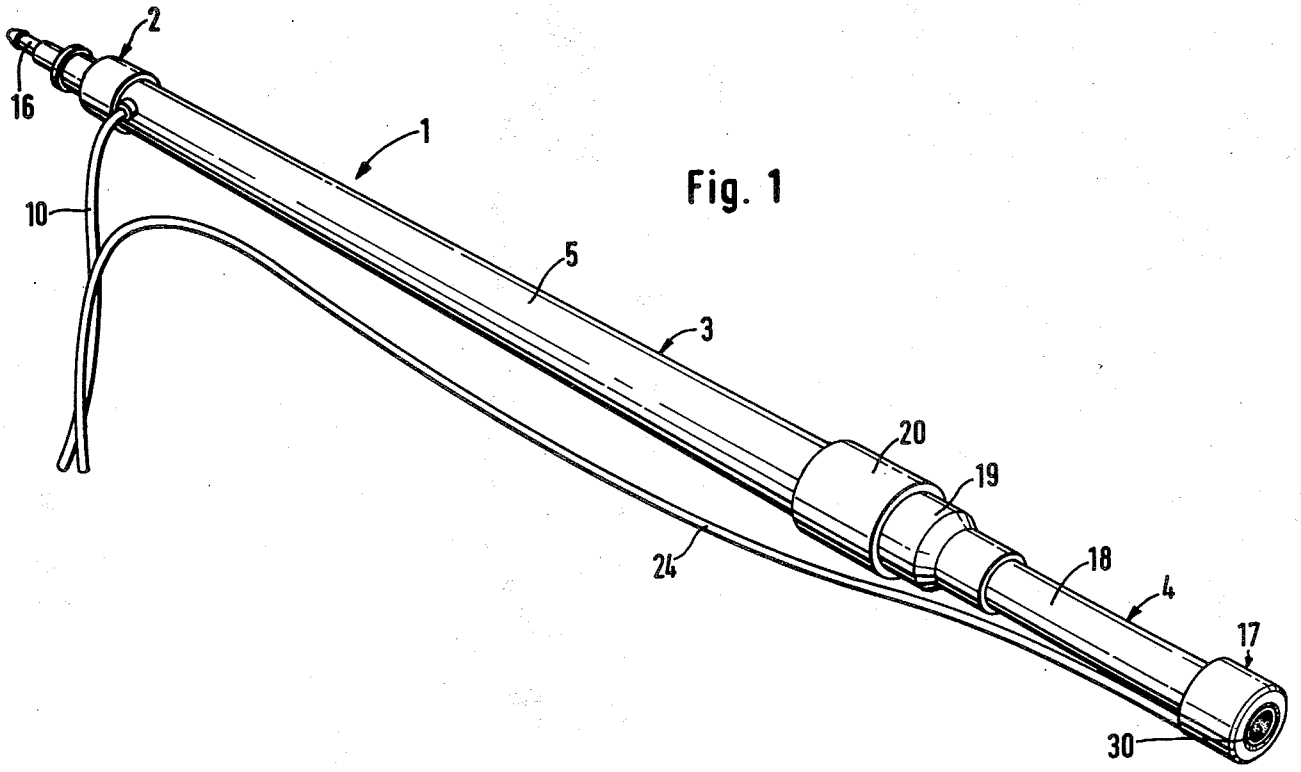
Figure 2:
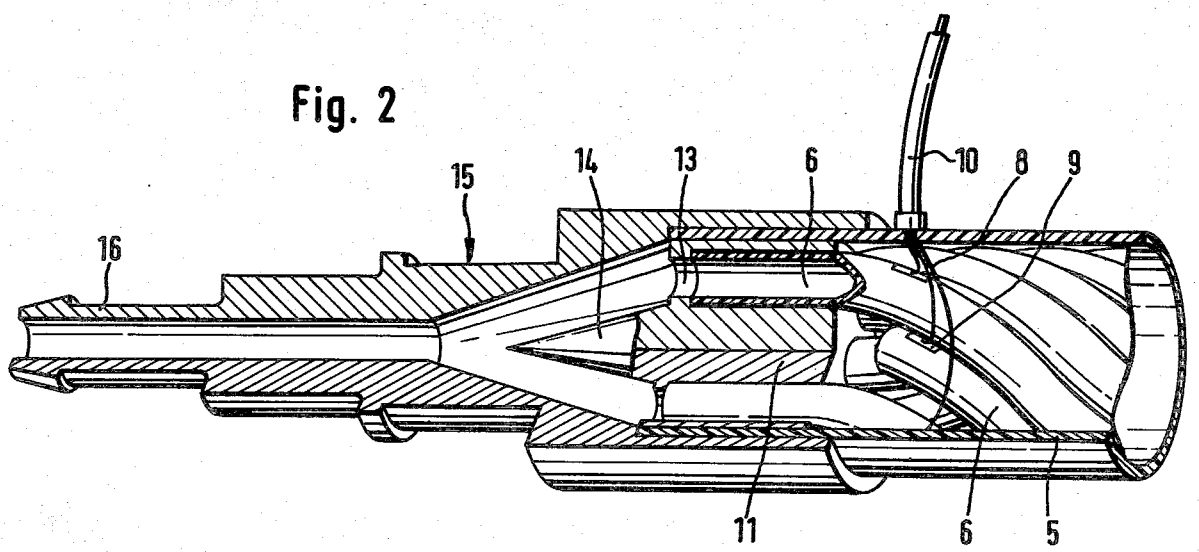
Figure 3:
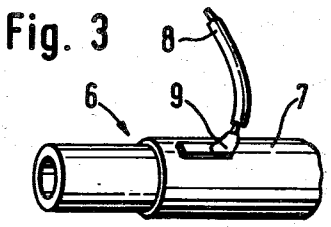
Figure 4:
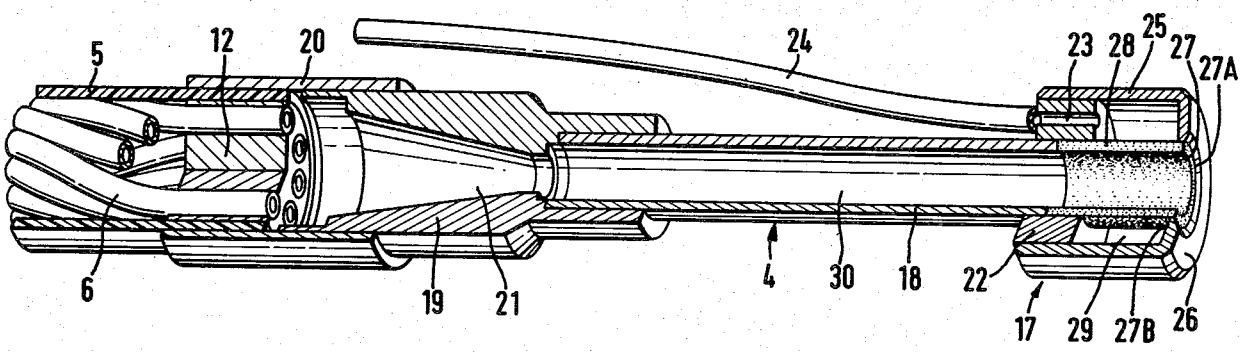
Figure 5:
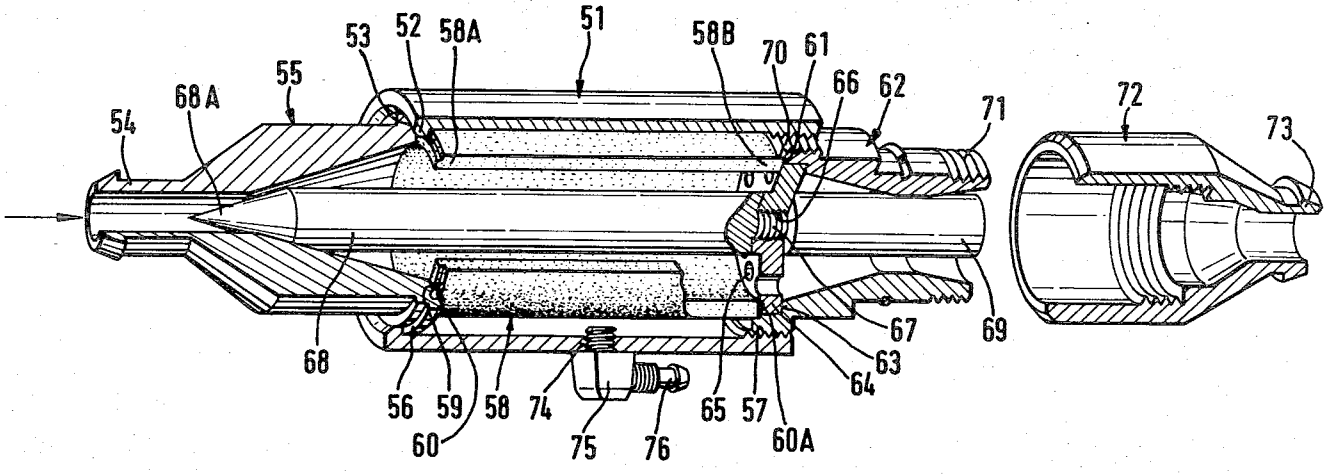
Figure 6:
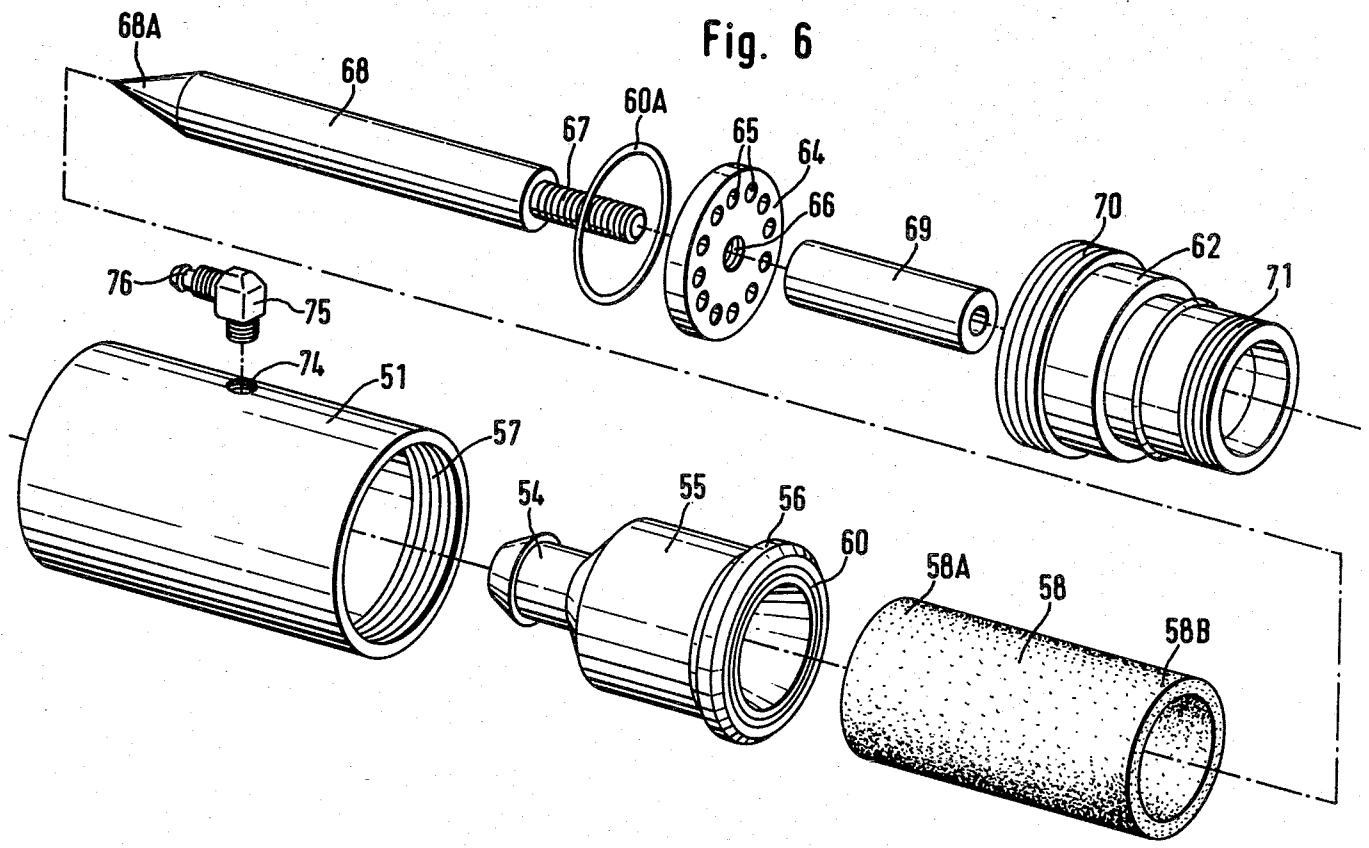

Two examples of embodiment of the invention will be described in the following, reference being made to the accompanying drawings, in which FIG. 1 is a perspective view of a means according to the invention and mounted on a powder sprayer, FIG. 2 shows the rear end of the sprayer in a partly sectional view, FIG. 3 shows a transportation and charging tube forming part of the sprayer and conductor connected to said tube, FIG. 4 shows the front end of the sprayer and the means in a partly sectional view, FIG. 5 shows a second example of embodiment of a means according to the invention for the disintegration and distribution of solid particles in powder form transported in a gas stream in a partly sectional view, and FIG. 6 is an exploded view of the means illustrated in FIG. 5.

A means according to the invention and intended to be connected to a powder sprayer 1 is as mentioned above especially adapted to be used in connection with powder spraying, the sprayer preferably being supported and operated by a robot unit. The sprayer substantially comprises three components. A rear component 2 constitutes a connecting component, by means of which a hose, in which colour powder is transported from a colour hopper, can be connected. The colour powder is transported through a central component at the same time as it is electrostatically charged. A front component 4 forms the nozzle of the sprayer. The central component 3 comprises a tube 5 preferably made of plastic material. A core formed by a number of tubes 6 of long extension but of smaller dimension and helically twisted together are enclosed in this tube 5. Also these small tubes 6 are preferably made of plastic or some other non-conducting material. A layer of metal 7 or any other conducting material surrounds each one of these charging tubes 6, as is evident from FIG. 3. At the rear end of the charging tubes 6, as seen in the direction of transportation, there is a conductor 8 connected to said metal layer 7, by way of example by means of a soldered joint 9. These conductors 8 converge and blend into a common conductor 10, which is led through an opening of the outer tube 5 to the outside of the tube and can be grounded or connected to a power source. Each one of the terminal ends of the charging tubes 6 is introduced into a circular core, a rear core 11 and a front core 12 respectively. These cores 11, 12 along their periphery have a number of through openings 13, which are interspaced in a ringshaped arrangement and adapted to the respective charging tubes 6. A cone 14 is provided in the centre of the rear core 11 and points in a direction against the direction of transportation, said cone functioning as an atomizer for the powder rushing in. The rear end of the outer tube 5 supports a sleeve 15, which at the one of its ends pointing away from the tube 5 is provided with connections 16 for coupling together the colour sprayer 1 and a hose, in which colouring powder is transported from a colour hopper. The nozzle 4 is attached to the opposite end of the tube. This nozzle component 4 comprises a spray nozzle 17, a connecting tube 18 and a throttle sleeve 19. The throttle sleeve 19 is with its rear end by means of a coupling sleeve 20 connected with the charging tubes 6 and surrounds the front end of the outer tube 5 and has a conically tapering through passage 21 extending in direction away from said tube, in which passage the powder charged is guided towards the central axis of the sprayer 1 and the nozzle 17. The connecting tube 18 is with its rear end introduced into and held by the throttle sleeve 19. A connecting ring 22 is threaded onto the tube 18 at its front end, and said ring 22 in its turn supports said sprayer nozzle 17. The connecting ring 22 is traversed by an axial duct 23, which at its rear end is connected with a hose 24 for the supply of gas, by way of example air. The nozzle 17 comprises a sleeve 25, which at its front end supports an end wall 26, which is provided with an opening 27 in central position. This opening 27 exhibits a chamfered edge 27A on its outside and a stepped shoulder 27B on its inside. The front end of a diffuser 28 is fitted into this stepped shoulder 27B, said diffuser having the form of a tube made of porous permeable material transmitting the air, by way of example manufactured in a sintering process. The rear end of the diffuser 28 is threaded into the connecting ring 22 and bears against the front end of the connecting tube 18. Gas, that is introduced at under pressure through the duct 23 of the connecting ring, flows into the chamber 29 formed between the nozzle 17 and the diffuser 28, whereafter it is subsequently spread through the small openings existing in the porous material, of which the diffuser is made, before it flows into the front portion of the through-duct 30 of the nozzle 4. During this phase pressure is created in the front portion of the nozzle, the powder and the gas current being compressed in order to expand and form a mist, when the mixture emerges out of the nozzle 17. By variation of this pressure the spreading of the powder can be regulated.

The function of the colour sprayer described above will now be described more in detail. The sprayer 1, as mentioned above, is with its rear end 16 by means of a hose connected with a colour hopper. The colour powder is by means of an air stream transported through the rear portion 2 of the sprayer 1 and by means of the cone 14 spread in outwards direction, so that it flows in through the openings 13 of the core 11 and further in through the charging tubes 6. As mentioned above, these tubes 6 are either connected with the ground or with a power source, by way of example a high tension power source, by means of the conductors 8, 10. On account of the helical form of the charging tubes 6 the powder whirls around in them during the transportation, and all sides of the particles will arrive in contact with the walls of the tube. When emerging out of these charging tubes 6 the powder is thoroughly charged. After emerging from these tubes 6 the flow of powder is throttled by the throttling component 19 and is led through the connecting tube 18 to the spreading nozzle 17 through the flow duct 30. As has already been described, the powder is mixed with the air flowing in through the duct 24 andthe diffuser 28 and is compressed in order to expand when flowing out of the orifice of the nozzle 27, as has been described above. The powder will then be spread in the form of a mist and on account of its electrostatic charge it will find a way to the object, which shall be painted and stick to the same. Also parts of the painting object, which are difficult to reach, will be covered with powder.

A means designed according to the invention and which is illustrated in FIGS. 5 and 6 and by way of example can be applied in ducts, where for example colour powder is transported between a hopper and a spray nozzle, is intended to disintegrate lumps and agglomerations of colour powder material, which can come into existence mostly in tube bends. In order to bring about this a means designed according to the invention can be connected with the transportation duct right in front of the powder spray nozzle, but it can of course also be connected at other places along the transportation duct, for example at tube bends.

The means is composed of a number of components, which can easily be assembled and in mounted condition form a tube-shaped component, as is evident from FIG. 5. A sleeve-shaped casing, which is indicated with the digit 51, forms the principal component of the means, in which the means is enclosed and by means of which the components forming part of the assembly are supported. At one end of the casing 51 there is an end wall 52, which is provided with an orifice 53 and which is facing counter to the direction of transportation, in the drawing marked by an arrow. An inlet muff 55, which at one end is provided with a hose connection 54, is inserted at the other end of the casing and with a flange 56 of annular shape bears against the inside of the end wall 52. The inlet muff 55 has an increasing cross-section in the direction of transportation, and is in the present example of conical form.

The opposite end of the casing 51 has a threaded portion 57 on the inside, the function of which will be described later on.

A diffuser 58, which has the form of a tube and which is made of a porous material transmitting the air, by way of example manufactured in a sintering process, is inserted into the casing 51 from its other end. One end 58A of this diffuser 58 is fitted into an annular shoulder 59 with an interspaced O-ring gasket 60, which is located on the flange 56 of the inlet muff 55. The other end 58B of the diffuser 58 is likewise fitted into an annular shoulder 61, which is arranged at one end of a ring-shaped fastening element 62. An additional annular shoulder 63 is located near to said shoulder 61 on the fastening element 62 and is, as is evident from FIG. 1, intended by means of an additional O-ring 60A in a sealing arrangement to receive a circular disc 64, which forms a throttle fastening component 64. This component 64 is provided with a number of through openings 65, which are interspaced along the periphery in annular arrangement, and has a central hole 66 intended to receive a threaded pin 67, which at one end is fastened to a core 68 of extended cylindrical shape and with a conical point 68A. The other end of the threaded pin 67 is intended to be screwed into a cylindrical component 69, which forms a secondary core 69 located on the opposite side of the disc 64 provided with a hole.

After mounting together the disc 64 with a hole and its cores 68 and 69 respectively, this unit is inserted into the casing 51, whereafter the fastening element 62, which at one end has a portion with male threads 70, is tightly screwed into the female threads 57 of the casing 51, so that the disc 64 with a hole is clamped between this fastening element 62 and the diffuser tube 58, which in its turn is clamped against the flange 52 of the casing. The fastening element 62 at one end has connections 71 intended to be coupled together with a loose tube component 72, which is provided with a hose connection 73. This hose connection 73 can of course be arranged on the fastening element 62 at its free end, if so desired. The casing 51 is provided with a threaded duct 74, into which a loose hose connecting component 75 is screwed. This component 75 has a hose connection 76 of the quick-coupling type, to which a supply duct for gas can be connected.

The function of the means described above will now be explained more in detail. The powder, which by means of for example compressed air is transported in tubes, is introduced at one end of the means. The flow of powder is spread at the conical portion 68A of the core 68 from the central portion of the means in a direction straight out to its periphery. Gas, which for example can be compressed air, is introduced through the connection 75 to the interior of the casing 51 and is spread through the small openings existing in the porous material, of which the diffuser 58 is made. At the introduction of this gas stream into the powder stream flowing through the interior of the means, the powder is mixed with the streaming gas resulting in its distribution at the same time as the mixture is subjected to compression. Lumps and other large sized agglomerations are, thus, effectively disintegrated by means of the means described.

The invention is not limited to the embodiments described above and illustrated in the drawings by way of example only, but can be varied as to its details within the scope of the following claims.

I claim:

1. Device for the disintegration and distribution of solid particles in powder form transported in a gas stream from a powder hopper to a powder sprayer in which the powder is electrostatically charged when it is transported in a number of curved tubes therein of long extension and small diameter, said device being disposed upstream of said powder sprayer and comprising a tube-shaped component made of porous material to transmit air through which said powder is transported, means for the introduction of a gas stream under pressure in the stream of powder in said component flowing from the hopper on its way to the powder sprayer, and a disc in said component provided with a plurality of through openings which have a maximum diameter corresponding to the diameter of the curved tubes, whereby the powder is mixed with the gas stream under pressure and lump and other large sized agglomerations are disintegrated before its transportation into the curved tubes.

2. Device according to claim 1, wherein said tube-shaped component is manufactured in a sintering process and is completely enclosed by a casing.

3. Device according to claim 2 wherein said casing comprises a sleeve having an end wall provided with an orifice, said tube-shaped component being supported by said end wall at one of its ends and by an annular fastening element at its other end.

4. Device according to claim 3, wherein said disc is clamped between said tube-shaped component and said annular fastening element.

5. Device according to claim 3, wherein said fastening element has threads along its periphery adapted to mate with threads located on the inside of said casing and there is provided a shoulder extending along the circumference of said fastening element arranged to receive and support said disc.

6. Device according to any one of claims 1 to 5, wherein there is provided a core having a conical point tapering in a direction contrary to the direction of transportation of said powder, said core being supported at the center of said disc.

7. Device according to claim 6, wherein said core is supported by a threaded member received in a hole in said disc, said threaded member supporting a second core extending in the direction of transportation of said powder.

8. Device according to any one of claims 3 to 5, wherein there is provided a muff held at a powder inlet of said device by means of a flange clamped between said end wall of said sleeve and the tube-shaped component, said muff having an increasing cross-section in the direction of transportation of said powder.

* * * * *